United States Patent [19]

Spelio

[11] 4,003,373

[45] Jan. 18, 1977

[54] VARIABLE PULSATING VACUUM DEVICE

[76] Inventor: Peter N. Spelio, P.O. Box 5857, Sherman Oaks, Calif. 91403

[22] Filed: June 23, 1975

[21] Appl. No.: 589,453

[52] U.S. Cl. ..... 128/40

[51] Int. Cl.[2] ..... A61H 1/00

[58] Field of Search ..... 128/38–40, 128/281, 297–300, 60, 24.1

[56] References Cited

UNITED STATES PATENTS

| | | | |
|---|---|---|---|
| 841,146 | 1/1907 | Hasbrouck | 128/40 |
| 882,532 | 3/1908 | McCall | 128/38 |
| 1,762,692 | 6/1930 | Lair | 128/38 |
| 2,652,048 | 9/1953 | Joers | 128/40 X |
| 3,236,231 | 2/1966 | Schneider et al. | 128/40 |

*Primary Examiner*—Lawrence W. Trapp
*Attorney, Agent, or Firm*—Clarence A. O'Brien; Harvey B. Jacobson

[57] ABSTRACT

A variable pulsating vacuum pneumatic device having a housing in which a motor and vacuum pump are mounted, with the latter being connected to an applicator used for treating facial and neck tissue. A transmission connects the motor to the pump, while a control circuit permits regulation of the pulse rate of the pump as a function of the speed of the motor.

9 Claims, 3 Drawing Figures

VARIABLE PULSATING VACUUM DEVICE

BACKGROUND OF THE INVENTION

1. Field of the Invention

This invention relates generally to a pulsating vacuum device, and particularly to a variable pulsating vacuum pneumatic device for use in the pneumatic therapy of facial and neck tissue.

2. Description of Prior Art

My prior U.S. Pat. No. 3,841,322, issued Oct. 15, 1974, discloses an applicator for use in pneumatic therapy, and a method of using such an applicator in order to reestablish facial and neck tissue. It is necessary, however, that in order to carry out the method of my aforementioned patent, a variable pulsating vacuum pneumatic device be employed which is designed to produce a requisite cyclic suction-relaxation action.

It is generally known to use a pulsating pneumatic device in order to intermittently subject the skin of a person to vacuum suction and release for the purpose of accomplishing a facial uplift without requiring surgery. U.S. Pat. No. 3,236,231, issued Feb. 22, 1966 to A. P. Schneider et al, discloses a facial uplift apparatus of this kind, as does U.S. Pat. No. 2,087,491, issued July 20, 1937 to B. W. Whitehurst. U.S. Pat. Nos. 2,234,101, issued Mar. 4, 1941 to L. J. Andres, U.S. Pat. No. 3,238,937, issued Mar. 8, 1966 to R. J. Stein, and U.S. Pat. No. 3,763,854 issued Oct. 9, 1973 to M. W. Welch, are also pertinent in this regard, although the device of U.S. Pat. No. 3,238,937 is directed to a pulsating vacuum device specifically intended for developing a woman's bust.

The aforementioned pulsating vacuum devices, however, are not particularly suitable for carrying out the novel method as set forth in my prior U.S. Pat. No. 3,841,322.

SUMMARY OF THE INVENTION

It is an object of the present invention to provide a variable pulsating vacuum pneumatic device specifically intended for carrying out the method set forth in U.S. Pat. No. 3,841,322.

It is another object of the present invention to provide a variable pulsating vacuum device suitable for use with people having different facial tissue characteristics.

It is still another object of the present invention to provide a variable pulsating vacuum device having a variation in the gliding process thereof of one-sixth of an inch to one-half inch, or possibly more, at the relaxation portion of the suction-relaxation cycle so as to fit the individual case being treated in accordance with the method set forth in U.S. Pat. No. 3,841,322.

These and other objects are achieved accordingly to the present invention by providing a variable pulsating vacuum pneumatic device having: a frame; a motor mounted on the frame; a vacuum pump mounted on the frame and connected to an applicator in contact with facial and neck tissue being treated; a transmission for connecting the motor to the vacuum pump; and a control arrangement for regulating the pulse rate of the vacuum pump as a function of the speed of the motor.

The frame advantageously forms a receptacle in which the motor, pump, and the transmission are disposed. A panel removably covers the receptacle, with a rheostat included in the control means being mounted on the panel and electrically connected to the, preferably, electric motor. The control arrangement may advantageously further include a voltmeter connected between the motor and a source of power so as to provide an indication of the speed of the motor as a function of the power being fed thereto.

A preferred form of the vacuum pump according to the invention includes a cylinder pivotally mounted in the receptacle and provided with a piston reciprocally disposed in the cylinder. A piston rod has one end connected to the piston and is arranged extending outwardly from the cylinder for connection to the transmission. The latter advantageously includes a crank connected between a rotating output of the motor and to the outwardly spaced end of the piston rod for converting the rotary motion of the motor to reciprocating motion that causes the piston to reciprocate within the aforementioned cylinder.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
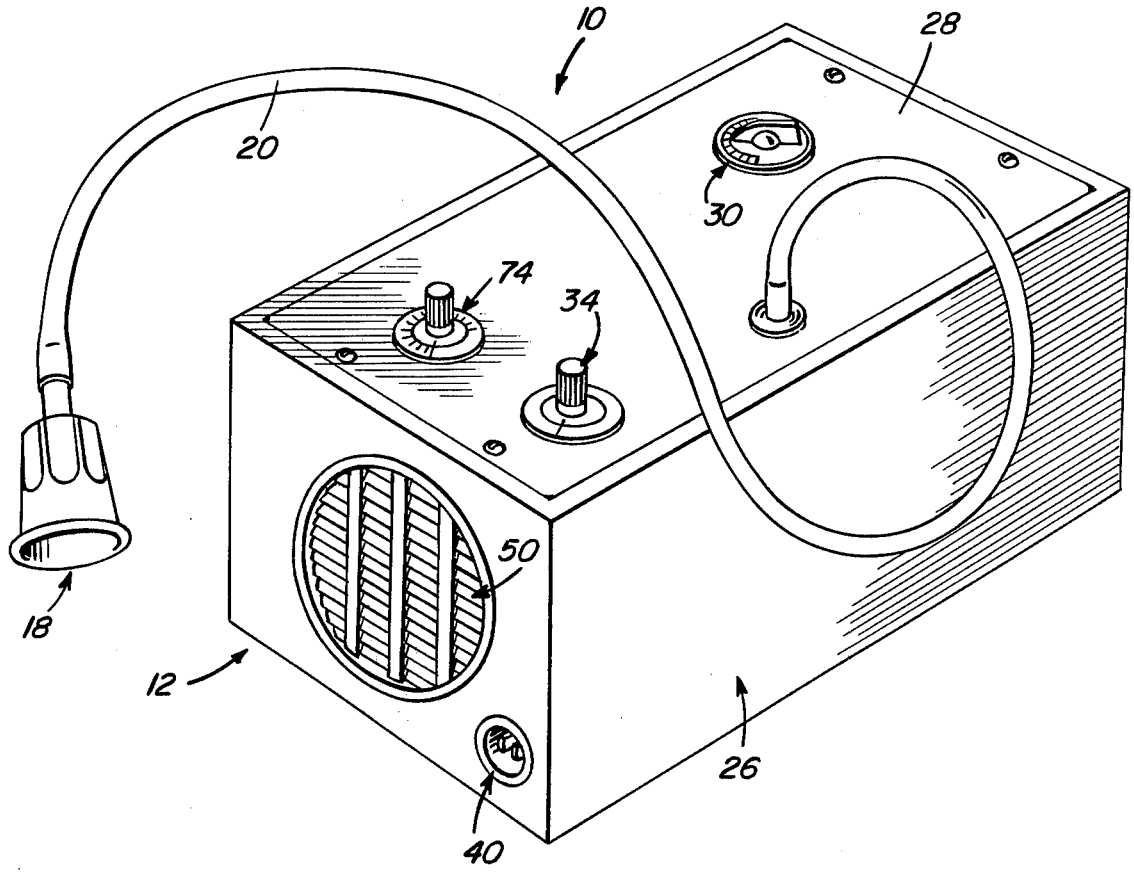
FIG. 1 is a perspective view showing a variable pulsating vacuum device according to the present invention connected to an applicator as disclosed in my prior U.S. Pat. No. 3,841,322.
Figure 2:
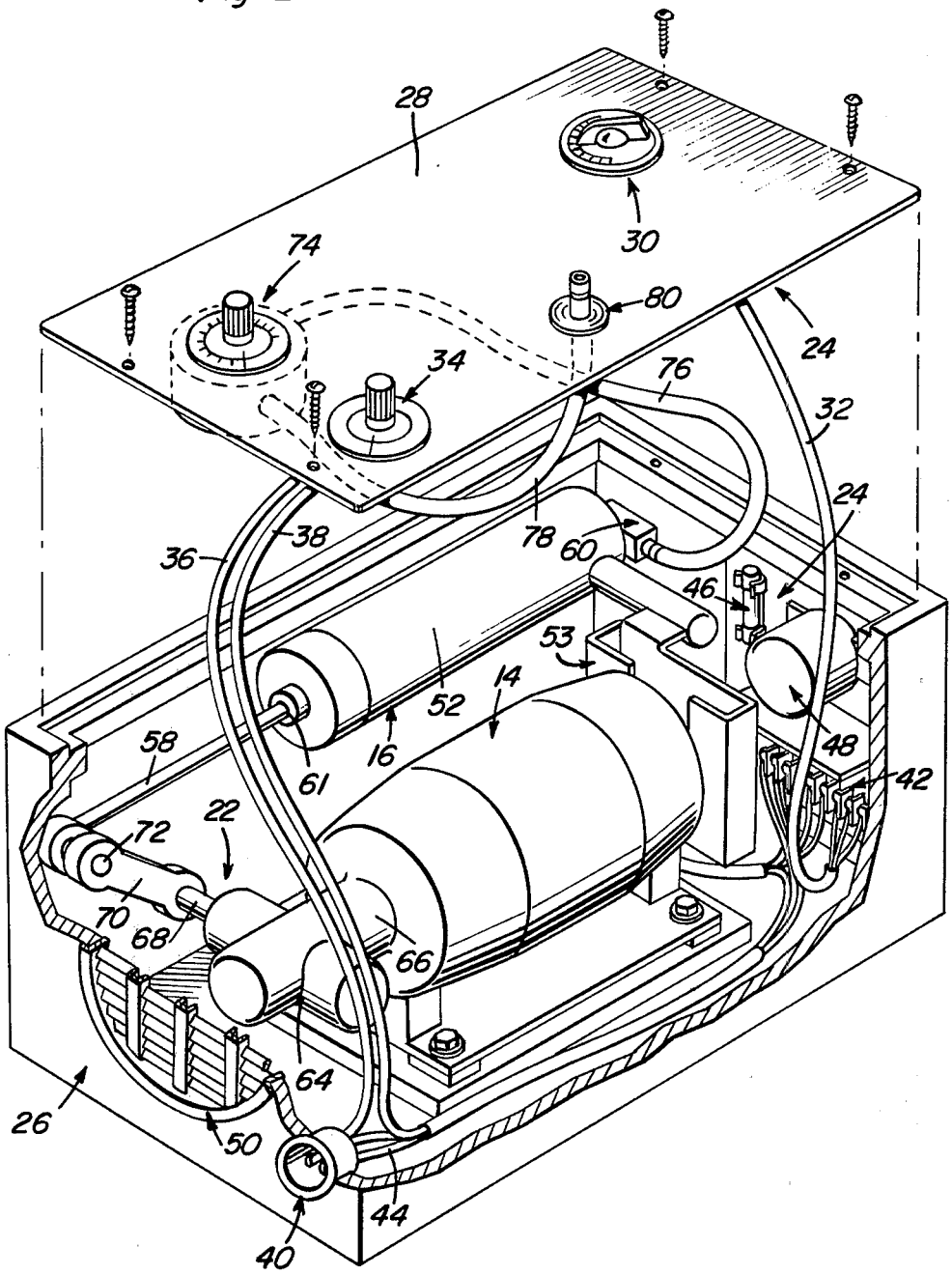
FIG. 2 is an exploded, perspective view, partly cutaway and in section, showing the variable pulsating vacuum device of FIG. 1.

Referring now more particularly to FIGS. 1 and 2 of the drawings, a variable pulsating vacuum pneumatic device 10 according to the present invention has a frame 12 in the form of the illustrated housing in which a conventional variable-speed electric motor 14 and a vacuum pump 16 are mounted. Pump 16 is operably connected to an applicator 18, such as disclosed in my prior U.S. Pat. No. 3,841,322, for treating facial and neck tissues. The disclosure of my prior U.S. Pat. No. 3,841,322, issued Oct. 15, 1974, is hereby incorporated herein. Applicator 18 is connected to device 10, and more specifically pump 16 in a manner to be described below, as by a flexible hose 20 constructed from rubber, polyvinyl chloride, and the like tubing. A transmission arrangement 22, to be described in greater detail below, connects motor 14 to pump 16 so as to convert the rotary motion of motor 14 into the reciprocating motion of pump 16, while a control arrangement 24, also to be described in greater detail below, is provided for regulating the pulse rate of pump 16 as a function of the speed of motor 14.

Frame 12 includes the receptacle 26 in which motor 14, pump 16, and a transmission arrangement 22 are disposed. Frame 12 also includes a panel 28 arranged removably covering the cavity formed in receptacle 26. A rheostat 30, forming part of control arrangement 24, is mounted on panel 28 and electrically connected to motor 14 as by a suitable two-wire cable 32. As will be appreciated, electric motor 14 is advantageously connected to a suitable source of electric power, such as a conventional electrical outlet, in a manner to be described in greater detail below.

Figure 3:
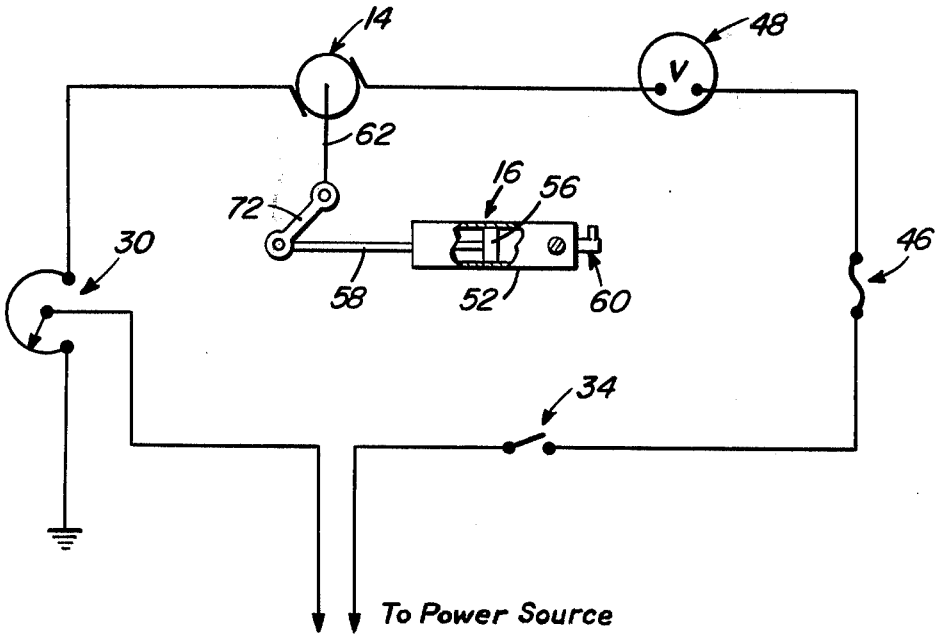
FIG. 3 is a schematic diagram showing the electrical control system for regulating the pulse rate of the vacuum pump of the variable pulsating vacuum device shown in FIGS. 1 and 2.

Control arrangement 24 further includes a conventional off-on power switch 34 also mounted in panel 28 and connected to motor 14 as by wires 36 and 38. As can be seen in FIG. 2, a conventional socket-style power receptacle 40 is mounted in receptacle 26, and wire 36 is connected to receptacle 40 while wire 38 runs directly to a terminal board 42. From the latter comes a wire 44 which is also connected to receptacle 40 to complete a circuit between switch 34 and terminal board 42. From terminal board 42 runs a pair of wires to motor 14; however, the power from power receptacle 40 first passes through cable 32 and rheostat 30 in order that the power fed into motor 14 may be appropriately adjusted. A fuse 46, of conventional construction, is inserted between switch 34 and a conventional voltmeter 48 for providing protection to the control circuit for motor 14, which circuit is shown in FIG. 3 of the drawings. By proper calibration of the scales associated with rheostat 30 and voltmeter 48, the speed of motor 14, and thus the pulse rate of pump 16, can be accurately controlled.

As can also be seen from FIG. 2, voltmeter 48, as well as fuse 46, are advantageously mounted on one end wall of receptacle 26, while a suitable vent is provided in the other end wall of receptacle 26 as is clearly seen in FIGS. 1 and 2. Such a vent 50 will function in a known manner to help create a flow of cooling air over motor 14 and pump 16 while same are operating.

Pump 16 includes a cylinder 52 pivotally mounted on a bracket 53 as by a suitable hinge 54. Bracket 53 is itself disposed within receptacle 26 and supported as by, for example, motor 14 in a conventional manner. A piston 56 (FIG. 3) is reciprocally disposed within cylinder 52, while a piston rod 58 has an end thereof connected to piston 56 and extends outwardly from cylinder 52 for connection to transmission arrangement 22 by an end of piston rod 58 disposed outside of cylinder 52 and spaced from the end of the piston rod 58 affixed to piston 56.

A suitable fitting 60 is provided on the end of cylinder 52 opposite the end provided with the opening 61 through which piston rod 58 slidably passes in order to permit ingress and egress of air, and the like, from that portion of cylinder 52 between piston 56 and the fitting 60.

Motor 14 includes a shaft 62 (FIG. 3) which could be connected directly to a crank as described below, but is preferably connected to a conventional right-angle drive 64 having an input 66, to which shaft 62 of motor 14 is suitably affixed, and an output shaft 68 arranged 90 degrees with respect to input 66. The cylinder 52, piston rod 58, and pump 16 are advantageously arranged in the illustrated manner substantially parallel to the axis of rotation of motor shaft 62. A crank 70 is connected at spaced points pivotally to the end of piston rod 58 extending out of cylinder 52 and affixed to the output shaft 68 of drive 64 for rotation by the latter, with the result being that the rotary motion of motor shaft 62, output shaft 68 of drive 64, and crank 70 be converted to reciprocating motion of piston rod 58. Further, the importance of the pivotal mounting of cylinder 52, as by hinge 54, will be appreciated as being necessary to permit crank 70 to rotate while connected to piston rod 58. The pivotal connection of crank 70 to piston rod 58 may be accomplished in a conventional manner as by the use of a pin 72.

A conventional pressure regulator 74 is advantageously connected between fitting 60 of pump 16 and hose 20 which connects applicator 18 to the variable pulsating vacuum device 10. Accordingly, pressure regulator 74 is mounted in panel 28 for regulating pressure to applicator 18, and a hose 76 connects fitting 60 provided on cylinder 52 to pressure regulator 74, while a hose 78 connects pressure regulator 74 to a fitting 80 which facilitates attachment of hose 20 to device 10.

As will be appreciated from the above description and from the drawings, a variable pulsating vacuum device 10 according to the invention provides a compact unit capable of accomplishing heavy duty work as well as light operations. Further, the unit is easily regulated at 130 to 190 revolutions per minute, in accordance with the methods set out in my aforementioned U.S. Pat. No. 3,841,322.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A variable pulsating vacuum pneumatic device, comprising, in combination:

a. a frame;

b. a motor mounted on the frame;

c. a vacuum pump mounted on the frame and connected to an applicator arrangeable in contact with facial and neck tissues to be treated;

d. transmission means for connecting the motor to the vacuum pump; and e. control means for regulating the pulse rate of the vacuum pump as a function of the speed of the motor, the vacuum pump including, in combination:

1. a cylinder pivotally mounted on the frame;

2. a piston reciprocally disposed in the cylinder;

3. a piston rod having an end connected to the piston and extending outwardly from the cylinder, the piston rod having another end disposed outside the cylinder and spaced from the one end, the another end being connected to the transmission means, the motor including a shaft rotatable about an axis, and the transmission means including a right-angle drive having an input and output 90 degrees apart and mounted on the motor shaft by the input for actuation by the motor shaft, the cylinder and piston rod of the pump being arranged substantially parallel to the axis of rotation of the motor shaft, the output of the right-angle drive including an output shaft, and a crank connected at spaced points pivotally to the another end of the piston rod and affixed to the output shaft of the drive for rotation by the latter, the rotary motion of the crank being converted to a reciprocating movement of the piston rod.

2. A variable pulsating vacuum pneumatic device, comprising, in combination:

a. a frame;

b. a motor mounted on the frame;

c. a vacuum pump mounted on the frame and connected to an applicator arrangeable in contact with facial and neck tissues to be treated;
d. transmission means for connecting the motor to the vacuum pump; and
e. control means for regulating the pulse rate of the vacuum pump as a function of the speed of the motor, the vacuum pump including, in combination:
1. a cylinder pivotally mounted on the frame;
2. a piston reciprocally disposed in the cylinder;
3. a piston rod having an end connected to the piston and extending outwardly from the cylinder, the piston rod having another end disposed outside the cylinder and spaced from the one end, the another end being connected to the transmission means, further including a pressure regulator mounted on the frame for regulating pressure to the applicator, and a hose connecting an outlet provided in the cylinder to the pressure regulator.

3. A variable pulsating vacuum pneumatic device, comprising, in combination:
a. a frame;
b. a motor mounted on the frame;
c. a vacuum pump mounted on the frame and connected to an applicator arrangeable in contact with facial and neck tissues to be treated;
d. transmission means for connecting the motor to the vacuum pump; and
e. control means for regulating the pulse rate of the vacuum pump as a function of the speed of the motor, the frame including a receptacle in which the motor, pump, and transmission means are disposed, and further including a panel removably covering the receptacle, the control means including a rheostat mounted on the panel and electrically connected to the motor, the motor being an electric motor connectible to a source of electric power, the vacuum pump including, in combination:
1. a cylinder pivotally mounted in the receptacle;
2. a piston reciprocally disposed in the cylinder;
3. a piston rod having an end connected to the piston and extending outwardly from the cylinder, the piston rod having another end disposed outside the cylinder and spaced from the one end, the another end being connected to the transmission means, the motor including a shaft rotatable about an axis, and the transmission means including a right-angle drive having an input and an output 90 degrees apart and mounted on the motor shaft by the input for actuation by the motor shaft, the cylinder and piston rod of the pump being arranged substantially parallel to the axis of rotation of the motor shaft, the output of the right-angle drive including an output shaft, and a crank connected at spaced points pivotally to the another end of the piston rod and affixed to the output shaft of the drive for rotation by the latter, the rotary motion of the crank being converted to a reciprocating movement of the piston rod.

4. A variable pulsating vacuum pneumatic device, comprising, in combination:
a. a frame;
b. a motor mounted on the frame;
c. a vacuum pump mounted on the frame and connected to an applicator arrangeable in contact with facial and neck tissues to be treated;
d. transmission means for connecting the motor to the vacuum pump; and
e. control means for regulating the pulse rate of the vacuum pump as a function of the speed of the motor, the frame including a receptacle in which the motor, pump, and transmission means are disposed, and further including a panel removably covering the receptacle, the control means including a rheostat mounted on the panel and electrically connected to the motor, the motor being an electric motor connectible to a source of electric power, the vacuum pump, including, in combination:
1. a cylinder pivotally mounted in the receptacle;
2. a piston reciprocally disposed in the cylinder;
3. a piston rod having an end connected to the piston and extending outwardly from the cylinder, the piston rod having another end disposed outside the cylinder and spaced from the one end, the another end being connected to the transmission means, further including a pressure regulator mounted on the panel for regulating pressure to the applicator, and a hose connecting an outlet provided in the cylinder to the pressure regulator.

5. A structure as defined in claim 4, wherein the control means further includes an off-on power switch connected to the motor and to the source of electrical power, and a fuse and a voltmeter connected between the motor and the source of power, the fuse and voltmeter being mounted in the receptacle and the switch being mounted on the panel.

6. A structure as defined in claim 4, wherein a vent is provided in the receptacle for facilitating the dissipation of heat from the motor and pump.

7. A structure as defined in claim 4, wherein the motor includes a shaft rotatable about an axis, and the transmission means includes a right-angle drive having an input and an output 90 degrees apart and mounted on the motor shaft by the input for actuation by the motor shaft, the cylinder and piston rod of the pump being arranged substantially parallel to the axis of rotation of the motor shaft, the output of the right-angle drive including an output shaft, and a crank connected at spaced points pivotally to the another end of the piston rod and affixed to the output shaft of the drive for rotation by the latter, the rotary motion of the crank being converted to a reciprocating movement of the piston rod.

8. A structure as defined in claim 7, wherein the control means further includes an off-on power switch connected to the motor and to the source of electrical power, and a fuse and a voltmeter connected between the motor and the source of power, the fuse and voltmeter being mounted in the receptacle and the switch being mounted on the panel.

9. A structure as defined in claim 8, wherein a vent is provided in the receptacle for facilitating the dissipation of heat from the motor and pump.

* * * * *